US007036159B2

(12) United States Patent
Tomita et al.

(10) Patent No.: US 7,036,159 B2
(45) Date of Patent: May 2, 2006

(54) TANKLESS TOILET, WESTERN-STYLE FLUSH TOILET, PART WASHING DEVICE AND SPUD FOR FLUSH TOILET

(75) Inventors: Katsunori Tomita, Tokoname (JP); Yasuhiro Shirai, Tokoname (JP); Koji Miwa, Tokoname (JP); Kenichi Ito, Tokoname (JP); Takanori Idota, Tokoname (JP); Masataka Mizutani, Tokoname (JP); Toshiaki Matushita, Tokoname (JP)

(73) Assignee: Inax Corporation, Tokoname (JP)

( * ) Notice: Subject to any disclaimer, the term of this patent is extended or adjusted under 35 U.S.C. 154(b) by 0 days.

(21) Appl. No.: 10/679,493

(22) Filed: Oct. 7, 2003

(65) Prior Publication Data

US 2004/0068785 A1 Apr. 15, 2004

Related U.S. Application Data

(62) Division of application No. 10/130,285, filed as application No. PCT/JP00/08309 on Nov. 24, 2000, now Pat. No. 6,675,399.

(30) Foreign Application Priority Data

| | | |
|---|---|---|
| Nov. 29, 1999 | (JP) | 11-338505 |
| Dec. 3, 1999 | (JP) | 11-345093 |
| Jan. 11, 2000 | (JP) | 2000-002384 |
| Jun. 9, 2000 | (JP) | 2000-173040 |
| Jun. 9, 2000 | (JP) | 2000-173042 |
| Jul. 11, 2000 | (JP) | 2000-209692 |

(51) Int. Cl.
*E03D 11/00* (2006.01)

(52) U.S. Cl. ..... 4/422

(58) Field of Classification Search ..... 4/422, 4/423

See application file for complete search history.

(56) References Cited

U.S. PATENT DOCUMENTS

| | | | | |
|---|---|---|---|---|
| 603,732 | A * | 5/1898 | Nicolle | 4/422 |
| 1,111,747 | A | 9/1914 | Haas | 4/336 |
| 1,928,717 | A | 10/1933 | Campus | 4/422 |
| 1,988,078 | A | 1/1935 | Guidetti | 4/448 |
| 2,116,529 | A | 5/1938 | McNeil | 4/423 |

(Continued)

FOREIGN PATENT DOCUMENTS

| | | |
|---|---|---|
| EP | 0 320 372 | 6/1989 |

(Continued)

*Primary Examiner*—Robert M. Fetsuga
(74) *Attorney, Agent, or Firm*—Oblon, Spivak, McClelland, Maier & Neustadt, P.C.

(57) ABSTRACT

The present invention provides a tankless toilet which can realize the reduction of the manufacturing cost without deteriorating the washing ability of water in the inside of a rim channel. The western-style toilet body includes the rim channel which is formed in the inside of a rim and is capable of washing a toilet bowl with water, and a rim water guide passage which is concealed in a rear wall face of the western-style toilet body and is connected to the rim channel from behind. Further, a through hole which is communicated with the rim water guide passage is formed in the rear wall face of the western-style toilet body. A spud is engaged in the inside of the through hole. The rim conduit is communicated with the rim channel by a water supply passage of the spud without passing the rim water guide passage, while an atmosphere communication hole of a water supply device is communicated with the rim water guide passage by means of a water discharge passage of the spud through a tube.

7 Claims, 6 Drawing Sheets

U.S. PATENT DOCUMENTS

| | | | | |
|---|---|---|---|---|
| 2,529,632 | A | 11/1950 | Russell et al. | 4/422 |
| 3,044,076 | A | 7/1962 | Martini | 4/420.4 |
| 3,467,966 | A | 9/1969 | Gregori et al. | 4/447 |
| 4,642,820 | A | 2/1987 | Boring, Jr. | 4/420.4 |
| 5,987,660 | A | 11/1999 | Wang | 4/420.4 |

FOREIGN PATENT DOCUMENTS

| | | |
|---|---|---|
| EP | 0 945 557 | 9/1989 |
| EP | 0 390 213 | 10/1990 |
| EP | 0 837 193 | 4/1998 |
| FR | 2 557 176 | 1/1985 |
| GB | 424903 | 3/1935 |
| GB | 798469 | 7/1958 |
| JP | 62-114967 | 7/1987 |
| JP | 01-116127 | 5/1989 |
| JP | 3-90723 | 4/1991 |
| JP | 03-253628 | 11/1991 |
| JP | 3-253630 | 11/1991 |
| JP | 105181/1992 | 9/1992 |
| JP | 4-138472 | 12/1992 |
| JP | 5-87079 | 11/1993 |
| JP | 06-042024 | 2/1994 |
| JP | 7-23065 | 4/1995 |
| JP | 07-207729 | 8/1995 |
| JP | 08-311963 | 11/1996 |
| JP | 2830316 | 9/1998 |
| JP | 11-36404 | 2/1999 |
| JP | 11-50511 | 2/1999 |
| JP | 11-131559 | 5/1999 |
| JP | 2000-27264 | 1/2000 |

* cited by examiner

TANKLESS TOILET, WESTERN-STYLE FLUSH TOILET, PART WASHING DEVICE AND SPUD FOR FLUSH TOILET

The present application is a divisional application of and claims priority under 35 U.S.C. § 120 to U.S. patent application Ser. No. 10/130,285, filed May 29, 2002, now U.S. Pat. No. 6,675,399, which is National Stage of PCT/JP00/08309, filed Nov. 24, 2000, the entire contents of which are incorporated herein.

TECHNICAL FIELD

This invention relates to a tankless toilet which has no water tank and directly feeds water supplied from a water supply pipe such as a city water service pipe or the like to a western-style toilet body so as to wash the western-style toilet body.

BACKGROUND ART

Conventionally, there has been known a western-style flush toilet which includes a western-style toilet body made of porcelain and a toilet flushing mechanism having a water tank such as a low tank made of porcelain which is mounted on a rear portion of the western-style toilet body and temporarily reserves water supplied from a water supply pipe such as a city water service pipe. The toilet flushing mechanism is capable of washing the western-style toilet body with the water reserved in the low tank. The water tank is mounted on a side wall of the toilet such that the tank is positioned outside the toilet body and has a large volume to spout a large amount of water into the toilet body at a time for ensuring the discharge of a waste from the western-style toilet body. Accordingly, such a western-style flush toilet generally requires a large space for mounting the water tank.

Accordingly, recently, from the viewpoint of effectively making use of the space of the toilet, a tankless toilet which is capable of directly supplying water fed from the water supply pipe to the western-style toilet body has been developed (Japanese Patent Laid-open No. 90723/1991, Japanese Patent Laid-open No. 253630/1991). In such a tankless toilet, a rim channel which is capable of flushing a bowl with water is formed in a rim of the western-style toilet body and a rim conduit is capable of supplying water to this rim channel by way of a rim water guide passage which is connected from a backside to the rim channel concealed in a wall face of the western-style toilet body. Further, as valve means, an open/close valve having an inlet port and an outlet port and a vacuum breaker having an atmosphere-communication hole are adopted. The water supply pipe is connected to the inlet port of the open/close valve by way of a conduit, while the rim conduit is connected to the outlet port. The atmosphere-communication hole of the vacuum breaker is communicated with the atmosphere above the uppermost surface of the rim channel. Further, this tankless toilet adopts the western-style toilet body having a support portion behind the rim and a fixed plate is fixedly mounted on the support portion of this western-style toilet body and the toilet flushing device is provided at the rear side of the fixed plate, and a toilet-seat and toilet-lid device is provided at the front side of a cover of the toilet flushing device such that the toilet-seat and toilet-lid device can be tilted upwardly and downwardly. The toilet-seat and toilet-lid device includes a toilet seat and a toilet lid.

In such a tankless toilet, water is fed to the inlet port of the open/close valve from the water supply pipe via the conduit, and then the water is fed to the rim channel of the western-style toilet body from the outlet port via the rim conduit due to the opening of an open/close valve. Accordingly, the water is spouted into the bowl so as to perform the flushing of the bowl. Further, the water jetted from a jet nozzle to a trap portion forcibly generates a siphon effect in the trap portion. Here, at this point of time, since the atmosphere-communication hole of the vacuum breaker has the downstream side of the vacuum breaker opened to the atmosphere, even when the water supply pipe, the conduit and the upstream side from these pipes become negative pressure, water in the rim channel is prevented from flowing backward to the valve means and the upstream side from the valve means.

Here, in the tankless toilet, the water flows in the rim channel at a high speed and hence, the rim conduit which is connected to the open/close valve is adopted to ensure the bowl washing ability. Further, from the viewpoint of enhancing the appearance, the rim conduit is concealed in the wall face. Further, in the tankless toilet, the water is jetted from the jet nozzle at a high speed and to ensure the generation of the effective siphon effect due to such a jetting of the water, a jet conduit which is connected to the open/close valve is adopted. Further, from the viewpoint of enhancing the appearance, the jet conduit is concealed in the wall face. Further, in this tankless toilet, because of the necessity to ensure the highly accurate contour dimensions, a base plate is interposed between the western-style toilet body and the open/close valve. Further, in view of the easiness of assembling, the rim conduit and the jet conduit are arranged such that they can be inserted into the open/close valve via the base plate. In this manner, the tankless toilet ensures the large flushing ability, the favorable appearance including the contour and the easiness of assembling.

Further, conventionally, there has been known a part washing device which includes a part washing mechanism which is mounted on the western-style toilet body and is capable of washing a part of a human body and a water supply device which is directly connected to a city water service pipe which supplies the water from outside and connects the city water service pipe and the part washing mechanism via a strainer.

Here, the strainer filters the foreign matters present in the water supplied from the city water service pipe to prevent the clogging of the part washing mechanism derived from the foreign matters present in the water. Then, in this part washing device, a cap is mounted on a lower end of the water supply device and the strainer disposed in the inside of the water supply device can be taken out by opening the cap. Further, the water supply device is concealed by a resin-made cover from the viewpoint of appearance and the cap of the water supply device is protruded downwardly so as to facilitate the take-out operation of the strainer disposed in the inside of the water supply device.

Further, a known spud for flush toilet is mounted on a through hole formed in a wall portion of the flush toilet body. In this manner, when this spud for flush toilet is mounted, for example, in the wall portion which faces the rim channel, the outlet port is positioned in the rim channel and can be used as a rim nozzle. In this rim nozzle, the water taken in through the inlet port is spouted in the rim channel from the outlet port.

DISCLOSURE OF THE INVENTION

However, the above-mentioned conventional tankless toilet is only of a type which adopts a unitary-type toilet flushing device in which the toilet flushing device is mounted on the western-style toilet body unitarily with the toilet-seat and toilet-lid device and there has been no case that the conventional tankless toilet is of a type which adopts a separate-type toilet flushing device in which the toilet flushing device is mounted on the western-style toilet body separately from the toilet-seat and toilet-lid device. Accordingly, at the time of purchasing, a purchaser of the tankless toilet who are considering the installment of the tankless toilet in a toilet room can only select the tankless toilet which is provided with the unitary-type toilet flushing device in which the toilet flushing device is mounted on the western-style toilet body unitarily with the toilet-seat and toilet-lid device. Accordingly, the free selection of the tankless toilet having the separate-type toilet flushing device which may become necessary due to a budget or the like is impossible.

Further, even if either the tankless toilet having the separate-type toilet flushing device or the tankless toilet having the unitary-type toilet flushing device is manufactured, so long as they do not use the common western-style toilet body, it is necessary to manufacture two kinds of western-style toilet body and hence, the efficiency of mass production is low and this pushes up the manufacturing cost of the western-style toilet body or the manufacturing cost of the tankless toilet.

This invention has been made in view of the above circumstance and it is a task to be solved by the invention to allow the purchaser to freely select the tankless toilet and to realize the reduction of the manufacturing cost of the tankless toilet.

With respect to a tankless toilet of this invention, to solve the above-mentioned task, in a tankless toilet including a western-style toilet body, a toilet-seat and toilet-lid device mounted on the western-style toilet body and a toilet flushing device which is mounted on the western-style toilet body, has no water tank and has a flushing mechanism capable of washing the western-style toilet body with water, the improvement is characterized in that the toilet flushing device is either a separate-type toilet flushing device which is mounted on the western-style toilet body separately from the toilet-seat and toilet-lid device or a unitary-type toilet flushing device which is mounted on the western-style toilet body integrally with the toilet-seat and toilet-lid device, and the western-style toilet body on which the separate-type toilet flushing device is mounted and the western-style toilet body on which the unitary-type toilet flushing device is mounted are used in common.

The tankless toilet of this invention adopts either the separate-type toilet flushing device or the unitary-type toilet flushing device. Accordingly, a purchaser of a tankless toilet who is considering the installment of the tankless toilet in a toilet room can freely select the tankless toilet adopting the separate-type toilet flushing device or the tankless toilet adopting the unitary-type toilet flushing device depending on a budget or the like at the time of purchasing.

Further, with respect to the tankless toilet of this invention, since the western-style toilet body is commonly used, it is sufficient to manufacture only one kind of western-style toilet body and hence, the highly-efficient mass production becomes possible whereby the reduction of the manufacturing cost of the western-style toilet body and eventually the reduction of the manufacturing cost of the tankless toilet can be realized.

It is preferable that the separate-type toilet flushing device and the unitary-type toilet flushing device use the common flushing mechanism. In this case, when the tankless toilet adopting the separate-type toilet flushing device as its toilet flushing device and the tankless toilet adopting the unitary-type toilet flushing device as its toilet flushing device are manufactured in a factory, their parts can be used in common so that the reduction of the manufacturing cost of the tankless toilet can be further enhanced.

Further, it is preferable that the separate-type toilet flushing device and the unitary-type toilet flushing device use the common base plate which is used for mounting the flushing mechanism to the western-style toilet body. In this case also, when the tankless toilet adopting the separate-type toilet flushing device as its toilet flushing device and the tankless toilet adopting the unitary-type toilet flushing device as its toilet flushing device are manufactured in a factory, their parts can be used in common so that the reduction of the manufacturing cost of the tankless toilet can be further enhanced. Further, at the time of mounting the separate-type toilet flushing device or the unitary-type toilet flushing device on the western-style toilet body, they can use the common manufacturing line until the flushing mechanism is mounted on the western-style toilet body by way of the base plate so that the reduction of the manufacturing cost of the tankless toilet can be further enhanced.

Further, it is preferable that the flushing mechanism is mounted on the western-style toilet body without interfering with other mechanism excluding the flushing mechanism in the unitary-type toilet flushing device. At the time of mounting the separate-type toilet flushing device or the unitary-type toilet flushing device on the western-style toilet body, provided that the flushing mechanism can be mounted on the western-style toilet body without interfering with other mechanism excluding the flushing mechanism in the unitary-type toilet flushing device, by mounting only the flushing mechanism to the western-style toilet body, the tankless toilet provided with only the flushing mechanism can be manufactured. On such a tankless toilet, a simple toilet-seat and toilet-lid device which only includes a toilet seat and a toilet lid can be mounted or alternatively, a toilet-seat and toilet-lid device which is provided with other mechanisms such as a part washing device which is capable of washing a part of a human body can be mounted. In this manner, the tankless toilet provided with the separate-type toilet flushing device can be manufactured. Further, by mounting other mechanisms except for the flushing mechanism after mounting the flushing mechanism, the tankless toilet provided with the unitary-type toilet flushing device can be manufactured. Accordingly, they can use the common manufacturing line until the flushing mechanism is mounted on the western-style toilet body so that the reduction of the manufacturing cost of the tankless toilet can be further enhanced. As other mechanism, a hot water tank of the part washing device or the like can be named.

The unitary-type toilet flushing device may include an inner cover which conceals the flushing mechanism and an outer cover which conceals the inner cover together with other mechanisms. Due to such a constitution, by concealing the flushing mechanism with the inner cover after mounting the flushing mechanism on the western-style toilet body, the tankless toilet provided with the separate-type toilet flushing device can be manufactured. Further, after mounting other mechanisms excluding the flushing mechanism, such other mechanisms can be concealed by the outer cover and hence, the tankless toilet provided with the unitary-type toilet flushing device can be manufactured. Accordingly, they can use the common manufacturing line until the flushing mechanism and the inner cover are mounted on the western-style toilet body so that the reduction of the manufacturing cost of the tankless toilet can be further enhanced.

When the western-style toilet body has toilet seat mounting holes which enable the mounting of the toilet-seat and toilet-lid device, the separate-type toilet flushing device can be mounted on the western-style toilet body at the rear side of the toilet-seat and toilet-lid device which is mounted with the toilet seat mounting holes. On the other hand, in this case, the unitary-type toilet flushing device is mounted on the western-style toilet body by means of at least toilet seat mounting holes.

It is preferable that the toilet seat mounting holes are designed such that a general toilet-seat and toilet-lid device can be mounted. The distance between these toilet seat mounting holes is prescribed by the JIS Standard in Japan, for example, such that the distance becomes 140 mm. Besides the above, the distance between the toilet seat mounting holes may be determined based on the standards of other countries such as United States of America or other nations.

BEST MODE FOR CARRYING OUT THE INVENTION

An embodiment which embodies this invention is explained hereinafter in conjunction with drawings.

Figure 1:
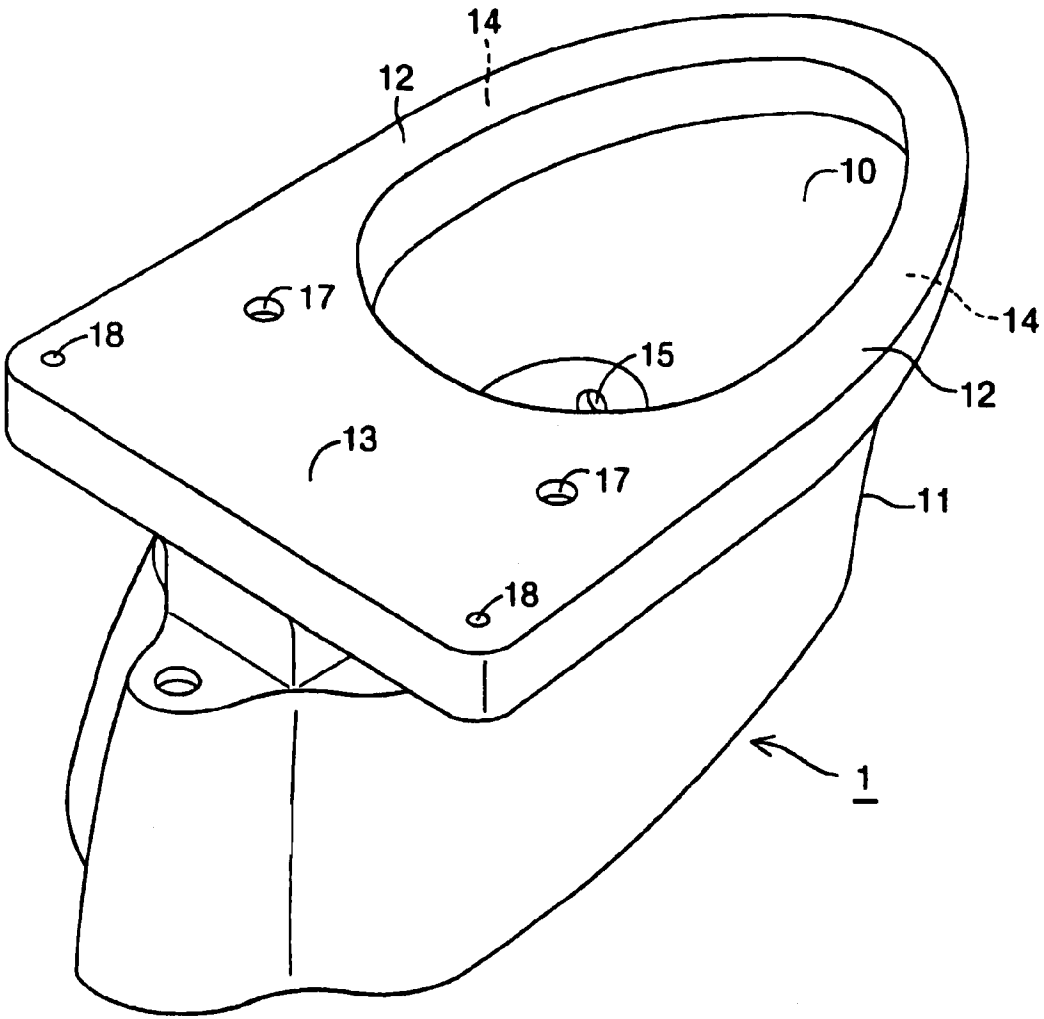
FIG. 1 is a perspective view showing a western-style toilet body of a tankless toilet according to an embodiment in this invention.

The tankless toilet according to this embodiment is a western-style flush toilet having no water tank and is provided with a western-style toilet body 1 which features this embodiment as shown in FIG. 1.

This western-style toilet body 1 is made of porcelain. This western-style toilet body 1 includes a toilet bowl portion 11 having a bowl portion 10 which receives a waste, a flat rim 12 which is formed in an approximately U shape on an upper peripheral portion of the front side of the toilet bowl portion 11 and a mounting surface 13 which is formed of a flat horizontal surface having a wide area at the rear side of the toilet bowl portion 11. A jet nozzle mounting hole 15 is formed in a bottom of the bowl portion 10. A rim channel 143 which supplies water into the inside of the bowl portion 10 is formed in the inside of the rim 12. As will be understood from the description made later, on the mounting surface 13, a separate-type toilet flushing device 2 (see FIG. 2 and the like) can be mounted or a unitary-type toilet flushing device 8 (see FIG. 6) which is of a different type from the separate-type toilet flushing device can be mounted. Accordingly, the mounting surface 13 functions as a common mounting surface.

A plurality of, that is, a pair of toilet seat mounting holes 17 are formed in the mounting surface 13 of the western-style toilet body 1 such that these holes 17 penetrate the mounting surface 13 in the vertical direction. The distance between these toilet mounting holes 17 is set to 140 mm. At the rear portion of the mounting surface 13 of the western-style toilet body 1, a plurality of, that is, a pair of toilet flushing device mounting holes 18 are formed such that these holes 18 penetrate the mounting surface 13 in the vertical direction. In the western-style toilet body 1, the toilet flushing device mounting holes 18 are formed behind the toilet seat mounting holes 17. As will be understood from the description made later, with use of the toilet flushing device mounting holes 18, the separate-type toilet flushing device 2 (see FIG. 2 and the like) can be mounted by way of the common base plate 3 and the unitary-type toilet flushing device 8 (see FIG. 6) which is of a different type from the separate-type toilet flushing device can be mounted by way of the common base plate 3 and hence, the toilet flushing device mounting holes 18 function as common mounting holes.

Figure 2:
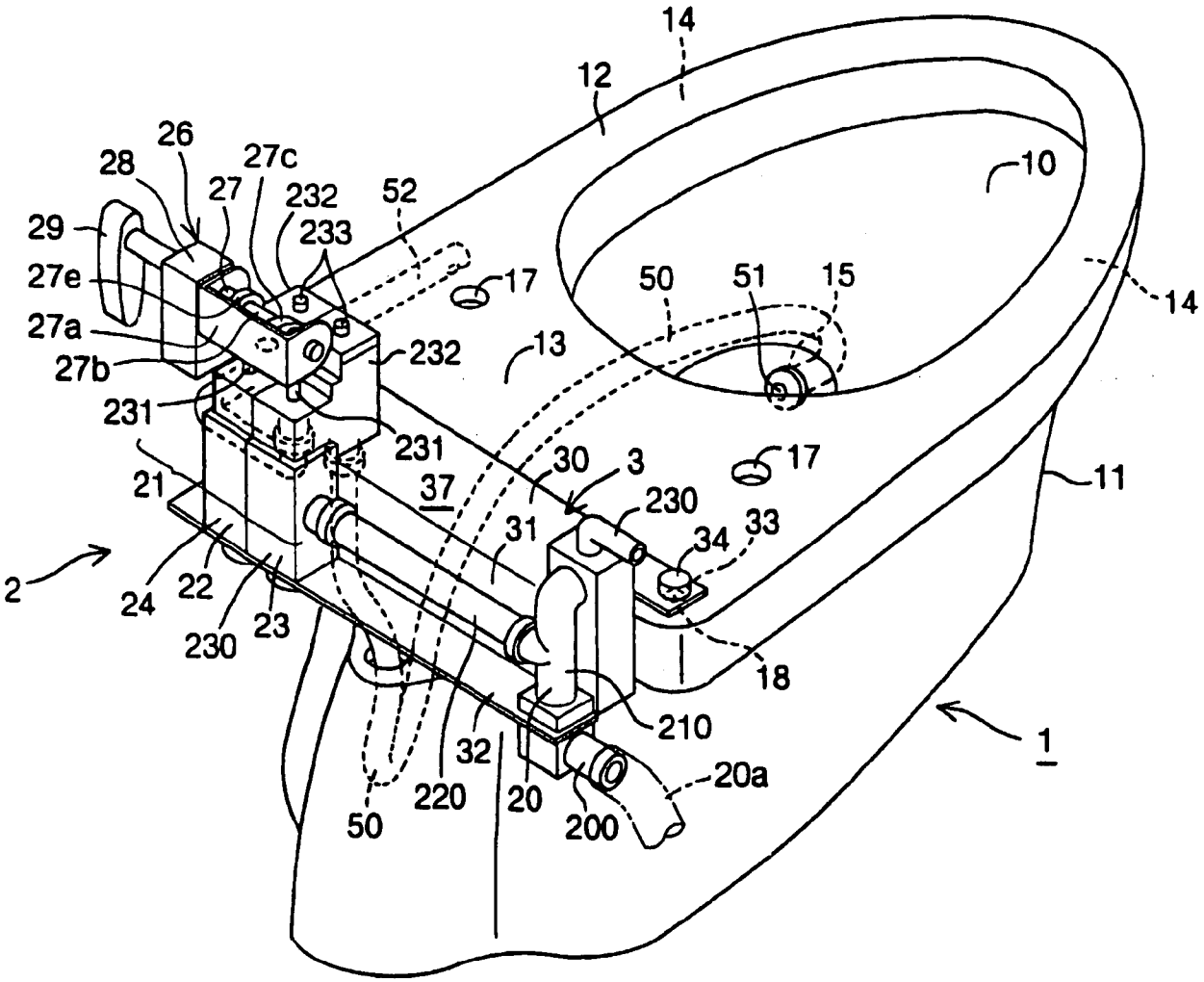
FIG. 2 is a perspective view showing a state in which a separate-type toilet flushing device is mounted on a western-style toilet body of a tankless toilet according to an embodiment in this invention.
Figure 3:
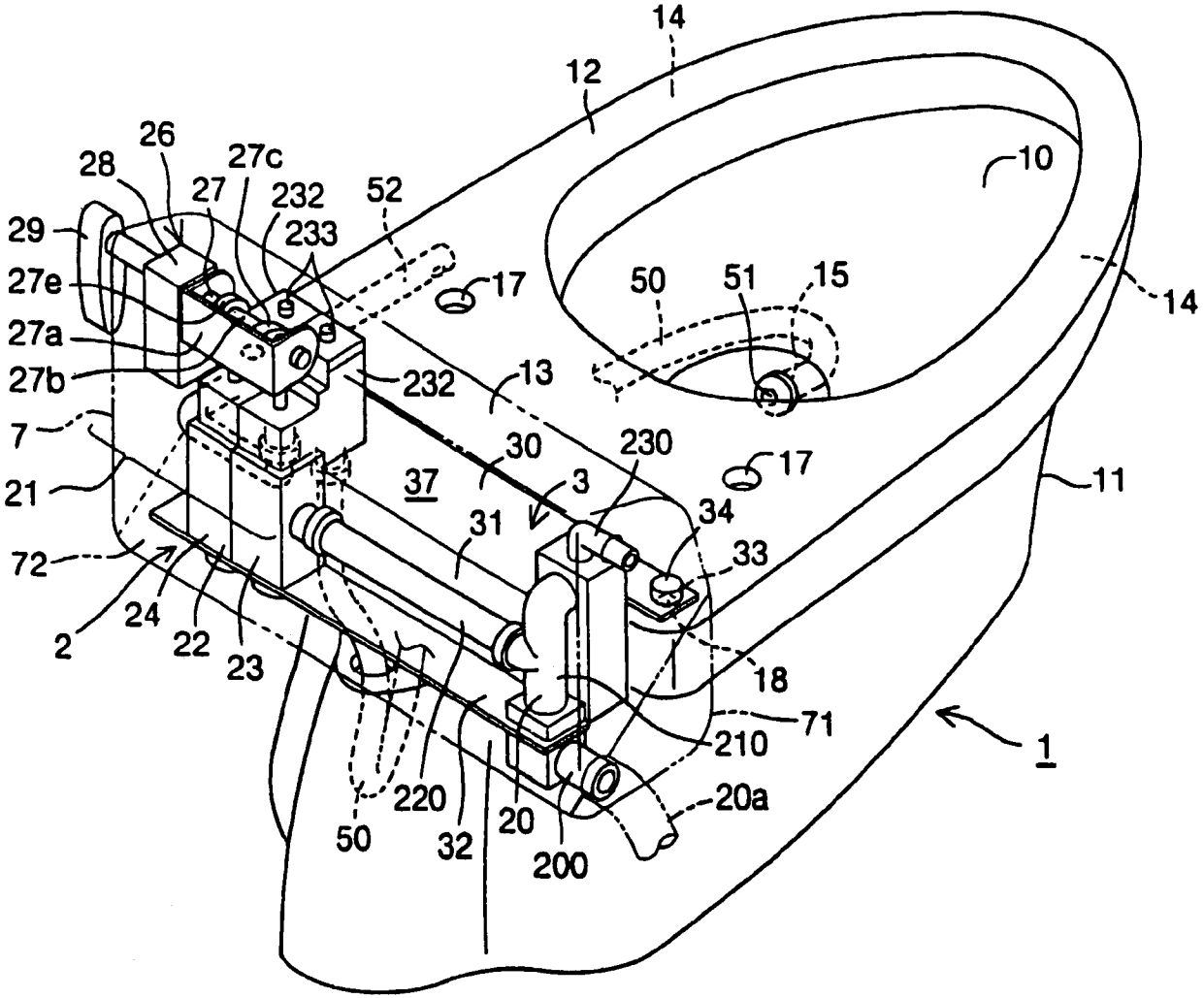
FIG. 3 is a perspective view showing a state in which an inner cover covers a separate-type toilet flushing device which is mounted on a western-style toilet body of a tankless toilet according to an embodiment in this invention.

FIG. 2 and FIG. 3 show the state in which the separate-type toilet flushing device 2 is mounted on the western-style toilet body 1 by way of the common base plate 3. The separate-type toilet cleaning device 2 is a toilet flushing device of a type which can be mounted on the western-style toilet body 1 separately from the toilet-seat and toilet-lid device 4 (see FIG. 4). Further, the common base plate 3 includes an upper horizontal plate portion 30 which is formed in an extended manner in the horizontal direction on the upper surface of the rear portion of the western-style toilet body 1 and has bolt through holes 33 at end portions, a longitudinal plate portion 31 which is formed in an extended manner in the vertical direction from the upper horizontal plate portion 30 and is arranged along a side surface of the rear portion of the western-style toilet body 1, and a lower horizontal plate portion 32 which is formed in an extended manner in the horizontal direction at the lower portion of the longitudinal plate portion 31. First mounting bolts 34 are made to pass through the toilet flushing device mounting holes 18 of the western-style toilet body 1 by way of the bolt through holes 33 and nuts not shown in the drawings are engaged with the first mounting bolt 34 so that the common base plate 3 is fixedly secured to the western-style toilet body 1. In this manner, the common base plate 3 and eventually the separate-type toilet flushing device 2 can be detachably mounted on the western-style toilet body 1. Above the upper horizontal plate portion 30 of the common base plate 3, a tank housing space 37 which can house a hot water tank 44 (see FIG. 5) which constitutes other mechanism is formed.

The separate-type toilet flushing device 2 is mounted on the common base plate 3. This separate-type toilet flushing device 2 includes a branch water supply device 20 which is connected to a stop valve not shown in the drawing which is connected to a water supply pipe such as a city water service pipe or the like not shown in the drawing by way of a flexible hose 20*a* and a flushing mechanism 21 which receives the supply of water from the branch water supply device 20 and is capable of washing the bowl portion 10.

The branch water supply device 20 includes a main pipe 210 which is provided with a water supply opening 200 which is connected to the flexible hose 20*a* having flexibility, a main conduit 220 which connects the main pipe 210 and the flushing mechanism 21 and is interposed between the main pipe 210 and the flushing mechanism 21 so as to supply the water to the flushing mechanism 21 and a branch pipe 230 which is usually closed and is opened at the time of use for allowing the branching of the water flow.

The flushing mechanism 21 includes valve means 22 which is arranged at one end side of the common base plate 3 and a drive device 26 which drives the valve means 22. The valve means 22 which constitutes a major component of the flushing mechanism 21 is formed by integrally assembling a first open/close valve 23 for jetting which performs the supply of water to a jet nozzle 51 and the stop of such a supply of water and a second open/close valve 24 for rim which performs the supply of water to a rim channel 141 or the stop of such a supply of water in a juxtaposed manner.

The first open/close valve 23 for jetting includes a housing 234 having a piston chamber not shown in the drawing in the inside thereof, a vertical-type rod 231 connected to an upper portion of a piston not shown in the drawing which is slidably held in the piston chamber, a connecting member 232 which is connected to the front side of the housing 234 and a vacuum breaker 233 which is mounted on an upper end of the connecting member 232. The vacuum breaker 233 is communicated with the atmosphere and is provided for suppressing the generation of negative pressure which is brought about along with the opening and closing of the first open/close valve 23 thus preventing the backflow of water derived from the generation of the negative pressure.

The second open/close valve 24 for rim has substantially the same constitution as that of the first open/close valve 23 for jetting and includes a housing 234, a vertical-type rod 231, a connecting member 232 and a vacuum breaker 233. A piston chamber of the second open/close valve 24 is communicated with the piston chamber of the first open/close valve 23 by way of a communication port not shown in the drawing and water is supplied to the second open/close valve 24 from the main conduit 220 of the branch water supply device 20 by way of the first open/close valve 23.

The drive device 26 is provided for opening or closing both of open/close valves 23, 24. This drive device 26 is constituted of a cam device 27 which is arranged above both open/close valves 23, 24 and a motor device 28 which operates the cam device 27. The cam device 27 includes a bracket 27*a* which has both ends thereof protruded in the frontward direction, a rotary shaft 27*b* which is rotatably held on the bracket 27*a* in the horizontal state and a first cam 27*c* and a second cam 27*e* which are fixedly secured to the rotary shaft 27*b*. The motor device 28 incorporates a motor and transmission gears which reduce the rotational speed of the motor therein. When the first cam 27*c* pushes the rod 231 of the first open/close valve 23 downwardly, the first open/close valve 23 is opened. When the second cam 27*e* pushes the rod 231 of the second open/close valve 24, the second open/close valve 24 is opened. When the pushing force is released, the first open/close valve 23 and the second open/close valve 24 are automatically closed due to return springs incorporated in these valves. A manually operating handle 29 is mounted on the drive device 26 so that the rotary shaft 27*b* of the cam device 27 is manually rotated at the time of power failure or when desired so that the first open/close valve 23 and the second open/close valve 24 can be manually opened or closed.

Between an outlet port of the first open/close valve 23 of the flushing mechanism 21 and the jet nozzle mounting hole 15, a jet conduit 50 is arranged such that the conduit passes through the inside of the western-style toilet body 1 and a jet nozzle 51 is mounted on a front end portion of the jet conduit 50. Due to such a constitution, water in the first open/close valve 23 is supplied to the jet nozzle 51 by way of the jet conduit 50.

A rim conduit 52 is arranged between an outlet port of the second open/close valve 24 of the flushing mechanism 21 and the rim channel 141. Due to such a constitution, the water in the second open/close valve 24 can be supplied to the rim channel 141 by way of the rim conduit 52.

Figure 4:
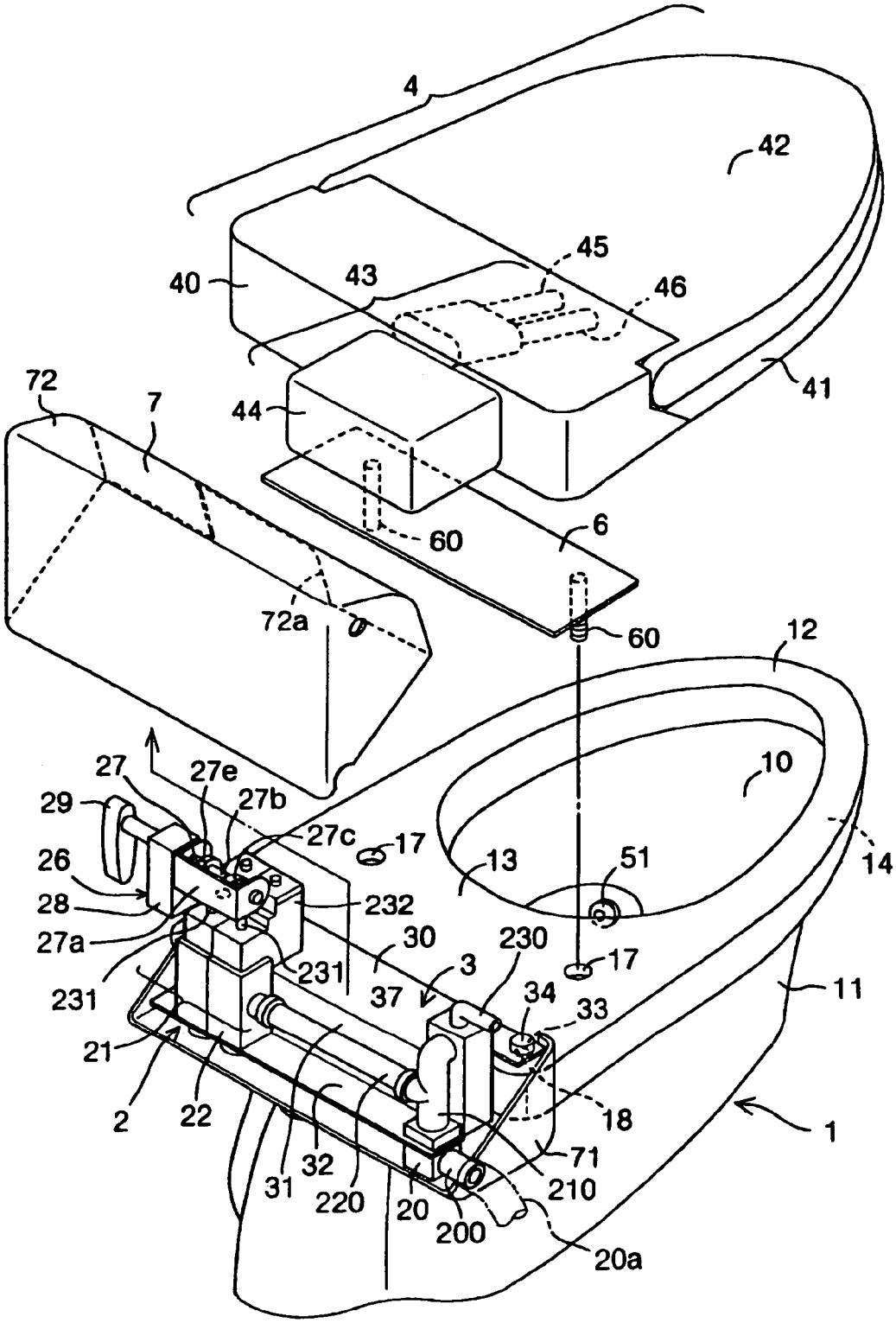
FIG. 4 is a perspective view showing a state in which a toilet-seat and toilet-lid device is mounted on a western-style toilet body on which a separate-type toilet flushing device is mounted according to an embodiment in this invention.

In this manner, the separate-type toilet flushing device 2 mounted on the western-style toilet body 1 is concealed by an inner cover 7 as shown in FIG. 3 and FIG. 4. The inner cover 7 has a box shape and is made of resin. This inner cover 7 is constituted of a detachable under cover portion 71 which covers the separate-type toilet flushing device 2 from the lower side and a detachable upper cover portion 72 which is detachably engaged with the under cover portion 71 and covers the separate-type flushing device 2 from the above side. A notch 72*a* which obviates the interference with the hot water tank 44 is formed on a front portion of the upper cover portion 72. When the inner cover portion 7 is mounted on the separate-type toilet flushing device 2, the handle 29 is exposed from the side surface of the inner cover 7 to allow the manual manipulation thereof.

As shown in FIG. 4, the toilet-seat and toilet-lid device 4 is provided separately from the separate-type toilet flushing device 2. This toilet-seat and toilet-lid device 4 includes a box-like base portion 40, a toilet seat 41 which is tiltably held on the base portion 40 and on which a user sits and a toilet lid 42 which is positioned above the toilet seat 41 and is capable of opening or closing an upper surface opening of the bowl portion 10 while being tiltably held on the base portion 40. Further, this toilet-seat and toilet-lid device 4 is provided with a part washing device 43 which is integrally held at a rear portion of the base portion 40. The part washing device 43 is provided for washing a part of a human body and includes a hot water tank 44 which is mounted on the base portion 40 as other mechanism provided with a built-in heater for generating hot water and a plurality of blow-off nozzles 45, 46 which are telescopically formed and are capable of blowing off hot water in the hot water tank 44 to the parts of the human body along with the extension thereof.

A plurality of second mounting bolts 60 which are formed in an extended manner downwardly from a base plate 6 for mounting toilet seat and toilet lid are respectively made to pass through toilet seat mounting holes 17 formed in the western-style toilet body 1 and nuts not shown in the drawings are fastened to these second mounting bolts 60 whereby the toilet-seat and toilet-lid device 4 can be detachably mounted on the mounting surface 13 of the western-style toilet body 1.

Figure 5:
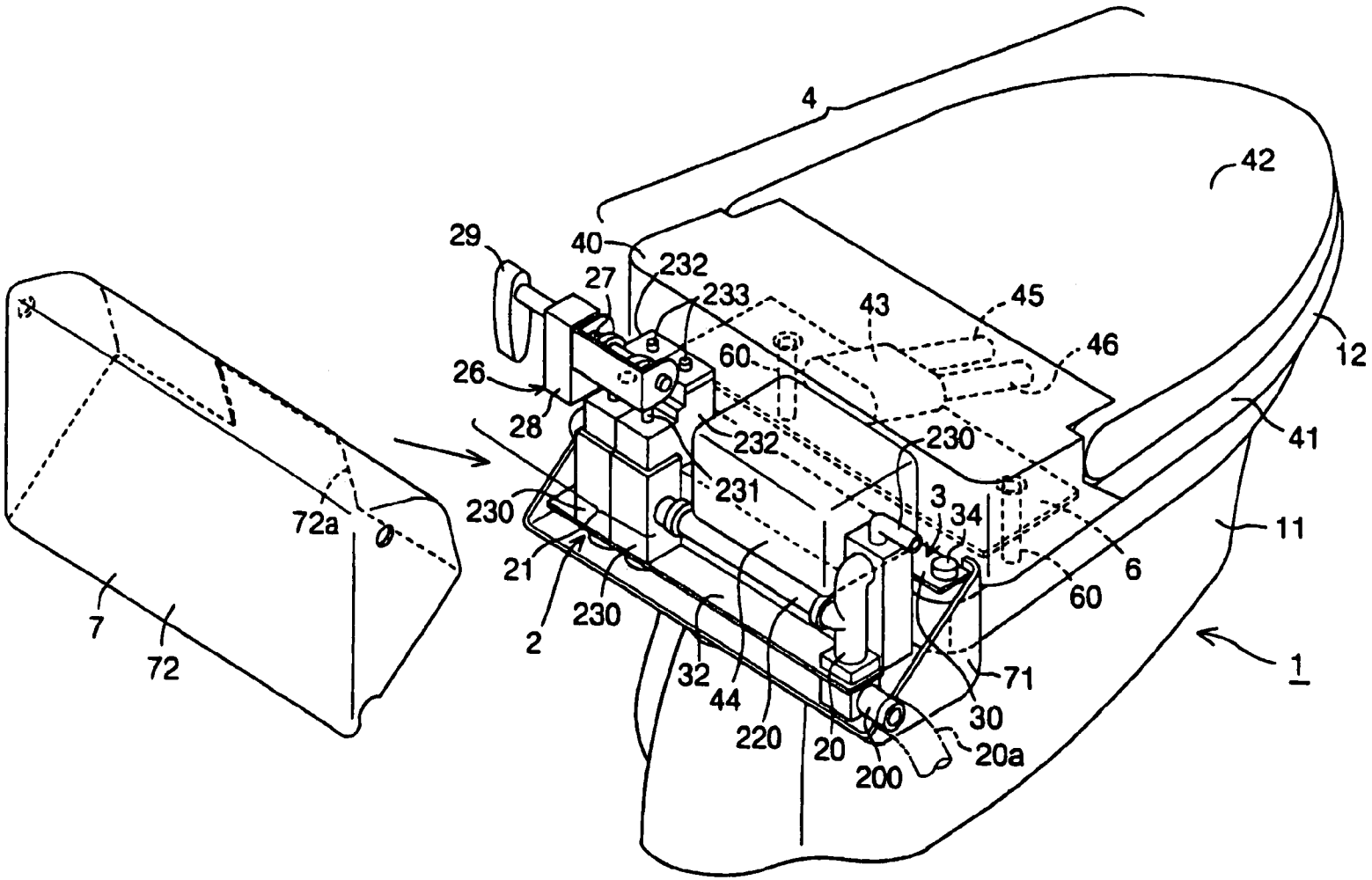
FIG. 5 is a perspective view showing a state in which a separate-type toilet flushing device and a toilet-seat and toilet-lid device are mounted on a western-style toilet body according to an embodiment in this invention.

In this manner, as shown in FIG. 5, the separate-type toilet flushing device 2 is mounted by means of toilet seat mounting holes 17 of the western-style toilet body 1 and is positioned behind the toilet-seat and toilet-lid device 4. In this state, the hot water tank 44 which is held on the rear portion of the toilet-seat and toilet-lid device 4 is arranged in a tank housing space 37 on the common base plate 3. As a result, at the time of mounting the separate-type toilet flushing device 2, the hot water tank 44 of the toilet-seat and toilet-lid device 4 is arranged such that the hot water tank 44 does not interfere with the flushing mechanism 21 and the branch water supply device 20 which constitute main components of the separate-type toilet flushing device 2 on the common base plate 3. In this manner, the tankless toilet in which the toilet flushing device constitutes the separate-type toilet flushing device 2 can be manufactured.

Here, since the upper cover portion 72 and the under cover portion 71 of the inner cover 7 are detachably engaged with each other, when the engagement is released, it becomes possible to disengage the upper cover portion 72 from the under cover portion 71 and hence, the maintenance and inspection of the separate-type toilet flushing device 2 become possible. Further, at the time of mounting, the hot water tank 44 of the toilet-seat and toilet-lid device 4 and the branch pipe 230 of the branch water supply device 20 are connected by a pipe passage such as a hose not shown in the drawing so that water is supplied from the branch pipe 230 to the hot water tank 44.

Figure 6:
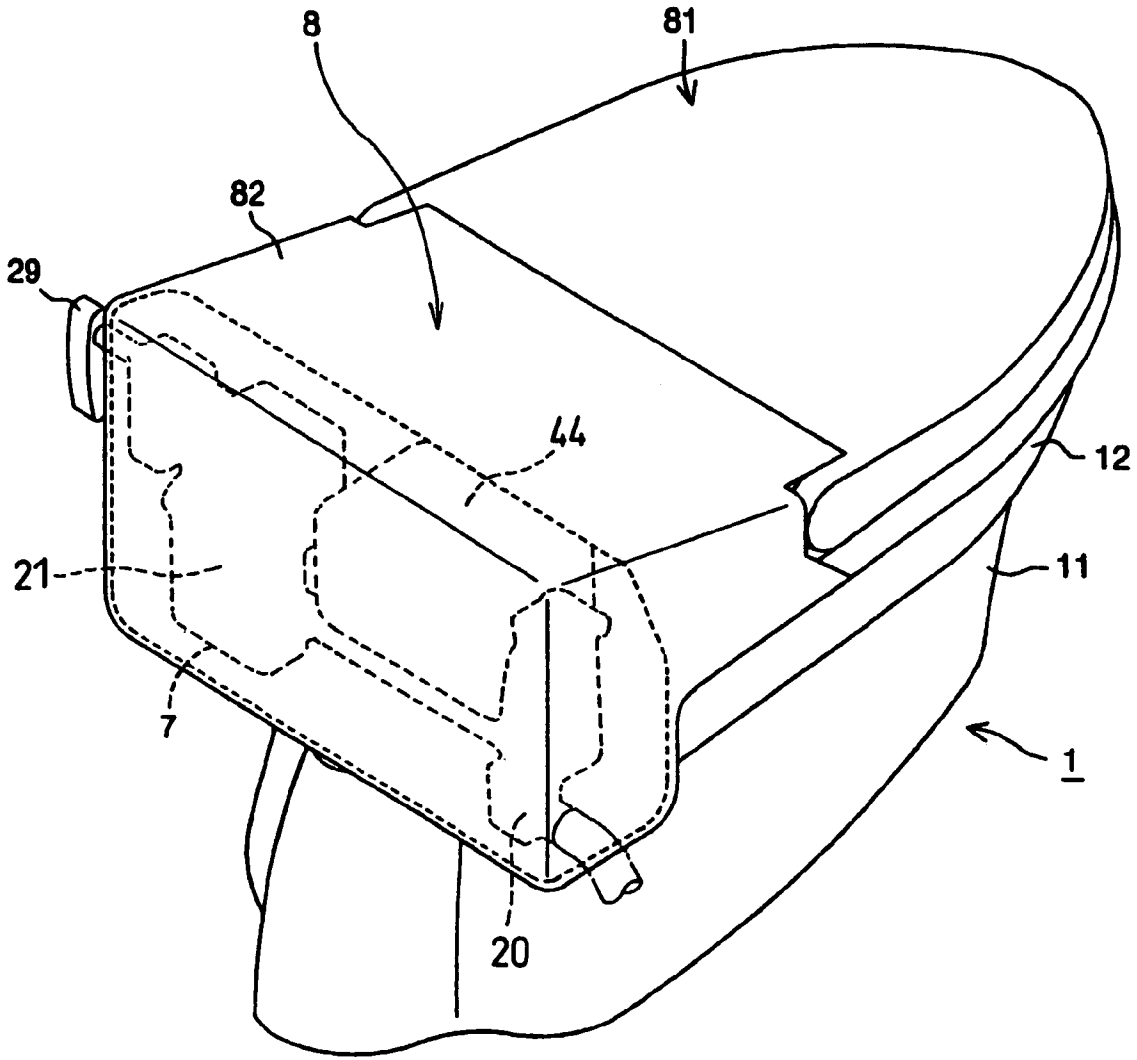
FIG. 6 is a perspective view showing a state in which a unitary-type toilet flushing device is mounted on a western-style toilet body of a tankless toilet according to an embodiment in this invention.

As described above, in a line which manufactures the tankless toilet which adopts the separate-type toilet flushing device 2 as the toilet flushing device, after the assembling is advanced to the state shown in FIG. 3, as shown in FIG. 6, the tankless toilet which adopts the unitary-type toilet flushing device 8 as the toilet flushing device can be manufactured.

Here, the unitary-type toilet flushing device 8 is integrally provided with the toilet seat/toilet lid toilet-seat and toilet-lid device 81 and an outer cover 82 which conceals the inner cover 7 together with the hot water tank 44 is provided behind the toilet-seat and toilet-lid device 81. When compared with the tankless toilet which adopts the separate-type toilet flushing device 2 as the toilet flushing device, the tankless toilet which adopts the unitary-type toilet flushing device 8 as the toilet flushing device is in common with respect to the western-style toilet body 1, the branch water supply device 20, the flushing mechanism 21, the common base plate 3 and the inner cover 7 of the unitary-type toilet flushing device 8. In this manner, the tankless toilet which adopts the unitary-type toilet flushing device 8 as the toilet flushing device is manufactured.

Since the tankless toilet which is manufactured in this manner adopts either the separate-type toilet flushing device 2 or the unitary-type toilet flushing device 8 as the toilet flushing device, a purchaser of a tankless toilet who is considering the installment of the tankless toilet in a toilet room can freely select the tankless toilet adopting the separate-type toilet flushing device 2 or the tankless toilet adopting the unitary-type toilet flushing device 8 depending on a budget or the like at the time of purchasing.

Further, with respect to the tankless toilet of this embodiment, since the western-style toilet body 1 is commonly used, it is sufficient to manufacture only one kind of western-style toilet body 1 and hence, the highly-efficient mass production becomes possible whereby the reduction of the manufacturing cost of the western-style toilet body 1 and eventually the manufacturing cost of the tankless toilet can be realized.

Further, according to the tankless toilet of the embodiment, the separate-type toilet flushing device 2 and the unitary-type toilet flushing device 8 are in common with respect to the branch water supply device 20, the flushing mechanism 21, the common base plate 3 and the inner cover 7 and hence, parts at the time of manufacturing can be used in common whereby the reduction of the manufacturing cost of the tankless toilet can be further enhanced.

Further, according to the tankless toilet of the embodiment, since they are common in these components, the common manufacturing line can be used until the inner cover 7 is mounted on the western-style toilet body 1. That is, according to the tankless toilet of the embodiment, since the flushing mechanism 21 can be mounted on the western-style toilet body 1 without interfering with the hot water tank 44 in the unitary-type toilet flushing device 8, it is possible to mount only the flushing mechanism 21 on the western-style toilet body 1 by way of the common base plate 3 and thereafter the inner cover 7 is mounted whereby the tankless toilet provided with only the flushing mechanism 21 can be manufactured. Here, although not illustrated, it is also possible to mount the toilet-seat and toilet-lid device which is provided with only the toilet seat and the toilet lid. It is also possible to mount the toilet-seat and toilet-lid device 4 having a part washing device. Due to such constitutions, it becomes possible to manufacture the tankless toilet provided with the separate-type toilet flushing device 2. In the tankless toilet provided with the separate-type toilet flushing device 2, when the tankless toilet provided with only the flushing mechanism 21 is initially purchased because of a budget or the like and the toilet-seat and toilet-lid device having a heating function, for example, is mounted on the tankless toilet and thereafter a purchaser wants to mount the toilet-seat and toilet-lid device 4 which is provided with other mechanism such as a part washing mechanism, the replacement of toilet-seat and toilet-lid device 4 can be easily performed.

Further, by mounting the toilet-seat and toilet-lid device 81 and the outer cover 82 after mounting the flushing device 21, the tankless toilet having the unitary-type toilet flushing device 8 can be manufactured.

In this manner, the common manufacturing line can be used until the inner cover 7 is mounted so that the reduction of the manufacturing cost of the tankless toilet can be further enhanced.

In this manner, according to the tankless toilet of the embodiment, the free selection by the purchaser becomes possible and the reduction of the manufacturing cost can be realized.

INDUSTRIAL APPLICABILITY

Accordingly, the tankless toilet of this invention allows the free selection of the purchaser and also can realize the reduction of the manufacturing cost.

What is claimed is:

1. A tankless toilet comprising:

a western-style toilet body;

a toilet-seat and toilet-lid device mounted on said western-style toilet body;

a toilet flushing device mounted on said western-style toilet body, having no water tank, and having a flushing mechanism to wash said western-style toilet body with water; and a branch water supply device connected to a hot water tank included in said toilet-seat and toilet-lid device; wherein said toilet flushing device is one of a separate-type toilet flushing device formed separately from said toilet-seat and toilet-lid device, and a unitary-type toilet flushing device formed integrally with said toilet-seat and toilet-lid device;

said western-style toilet body is one of a first western-style toilet body on which said separate-type toilet flushing device is mounted, and a second western-style toilet body on which said unitary-type toilet flushing device is mounted, and said first western-style toilet body and said second western-style toilet body are the same;

said flushing mechanism is one of a first flushing mechanism included in said separate-type toilet flushing device, and a second flushing mechanism included in said unitary-type toilet flushing device, and said first flushing mechanism and said second flushing mechanism are the same; and said branch water supply device is one of a first branch water supply device connected to said separate-type toilet flushing device, and a second branch water supply device connected to said unitary-type toilet flushing device, and said first branch water supply device and said second branch water supply device are the same.

2. A tankless toilet according to claim 1 further comprising:

a base plate mounting said flushing mechanism and said branch water supply device on said western-style toilet body; wherein said base plate is one of a first base plate included in said separate-type toilet flushing device, and a second base plate included in said unitary-type toilet flushing device, and said first base plate and said second base plate are the same.

3. A tankless toilet according to claims 1 or 2, wherein said flushing mechanism and said branch water supply device can be mounted on said western-style toilet body without being barred by said hot water tank.

4. A tankless toilet according to claim 3, wherein said unitary type toilet flushing device comprises:

an inner cover concealing said flushing mechanism and said branch water supply device; and an outer cover concealing said inner cover together with said hot water tank.

5. A tankless toilet according to claim 4, wherein said western-style toilet body comprises:

toilet seat mounting holes configured to mount said toilet-seat and toilet-lid device; wherein said separate-type toilet flushing device is mounted on said western-style toilet body behind said toilet-seat and toilet-lid device mounted by said toilet seat mounting holes.

6. A tankless toilet according to claim 3, wherein said western-style toilet body comprises:

toilet seat mounting holes configured to mount said toilet-seat and toilet-lid device; wherein said separate-type toilet flushing device is mounted on said western-style toilet body behind said toilet-seat and toilet-lid device mounted by said toilet seat mounting holes.

7. A tankless toilet according to claim 5, wherein a distance between said toilet seat mounting holes conforms to an accepted industrial standard.

* * * * *

UNITED STATES PATENT AND TRADEMARK OFFICE

CERTIFICATE OF CORRECTION

PATENT NO. : 7,036,159 B2
APPLICATION NO. : 10/679493
DATED : May 2, 2006
INVENTOR(S) : Tomita, et al.

It is certified that error appears in the above-identified patent and that said Letters Patent is hereby corrected as shown below:

On the title page, Item (54), the Title is incorrect. Item (54) should read:
--(54) TANKLESS TOILET--

Signed and Sealed this

Twenty-fifth Day of July, 2006

JON W. DUDAS
*Director of the United States Patent and Trademark Office*